United States Patent [19]

Brown

[11] Patent Number: 4,651,347

[45] Date of Patent: Mar. 24, 1987

[54] PROTECTIVE SHIELD FOR OUTER GARMENTS

[76] Inventor: Katie L. Brown, 237 E. Kennedy St., Syracuse, N.Y. 13205

[21] Appl. No.: 784,559

[22] Filed: Oct. 4, 1985

[51] Int. Cl.[4] ..... A41D 27/16

[52] U.S. Cl. ..... 2/60

[58] Field of Search ..... 2/60, 142, 129, 46

[56] References Cited

U.S. PATENT DOCUMENTS

| | | | |
|---|---|---|---|
| 1,526,324 | 2/1925 | Dormandy | 2/142 |
| 1,768,384 | 6/1930 | Villasenor | 2/60 |
| 2,637,034 | 5/1953 | Smith | 2/60 |

*Primary Examiner*—Doris L. Troutman

*Attorney, Agent, or Firm*—Bruns and Wall

[57] ABSTRACT

A protective shield that is adapted to overlie the collar of an outer garment such as an overcoat to protect the collar from being stained by hair gel or oil. The protective shield includes an outer or upper layer of real or simulated leather having a smooth, non-absorbent surface from which any oil or grease can be easily removed without staining. The outer, non-absorbent layer is connected to an inner cloth layer or lining that engages the overcoat collar and includes means for releasably attaching the protective shield to the overcoat.

7 Claims, 4 Drawing Figures

PROTECTIVE SHIELD FOR OUTER GARMENTS

BACKGROUND OF THE INVENTION

This invention relates generally to wearing apparel, and has particular reference to a novel protective shield for preventing hair gel or oil from staining the collar of an overcoat or the like.

A number of patents have been granted for devices that are intended to protect shirt collars from being soiled by a jacket or overcoat, or from being soiled by the wearer's own perspiration. Examples of such patents, developed in the course of a preliminary search, are U.S. Pat. No. 1,184,188 to Lipkey; U.S. Pat. No. 1,258,581 to Lussy; U.S. Pat. No. 1,388,056 to North; U.S. Pat. No. 2,634,420 to Jackson; U.S. Pat. No. 3,200,413 to Vaughan and U.S. Pat. No. 4 008 494 to Hicks. The Lipkey patent discloses a collar protector that attaches to an overcoat to prevent a shirt collar from being soiled by the inside of the overcoat.

The Lussey and North patents also disclose collar protectors that are attached to the inside of a coat collar to prevent the latter from soiling a shirt collar. The patent to Jackson discloses a protector, made up of layers of absorbent paper, which overlies a shirt collar to prevent the collar from becoming soiled as by perspiration. The Vaughan and Hicks patents both disclose collar protectors in the form of strips that are attached to the insides of shirt collars to protect them against soiling.

SUMMARY OF THE INVENTION

At the present time, a large number of people, male as well as female, wear their hair in tight curls sometimes called "Jeri Curls". The curly hairdo is done every three or four months by a hairdresser but must be maintained by daily applications of a moistening chemical in the form of a gel, a cream or an oil. This material stains whatever it touches and is particularly damaging to coat collars which are positioned relatively high on the neck of the wearer, adjacent the hair.

To minimize the problem briefly described above, the present invention provides a protective shield that is adapted to overlie the collar of an outer garment such as an overcoat to protect the collar from being stained by hair gel or oil. The protective shield includes an outer or upper layer of real or simulated leather having a smooth, non-absorbent surface from which any oil or grease can be easily removed without staining. The outer, non-absorbent layer is connected to an inner cloth layer or lining that engages the overcoat collar and includes means for releasably attaching the protective shield to the overcoat.

DESCRIPTION OF THE PREFERRED EMBODIMENT

Figure 1:
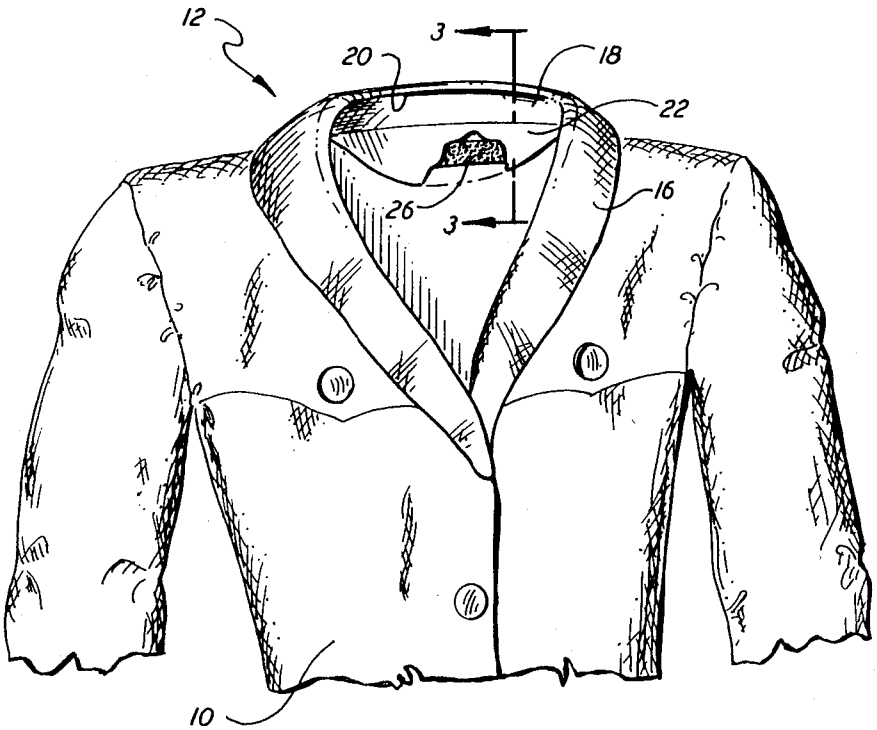
FIG. 1 is a fragmentary front elevation of a lady's overcoat to which a protective shield embodying the invention has been attached.

Having reference now to the drawings, FIG. 1 illustrates the upper part of a lady's overcoat 10 to which a protective shield generally indicated at 12 has been attached. While a cloth overcoat is shown in the embodiment disclosed, it should be understood that the shield 12 can be utilized with any type of outer garment, coat or jacket made of cloth or fur.

Figure 3:
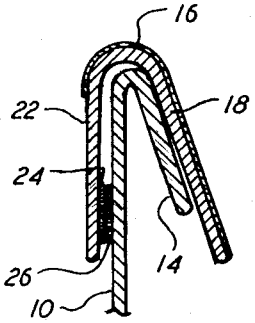
FIG. 3 is an enlarged transverse sectional view taken substantially on line 3—3 of FIG. 1.

The overcoat 10 has conventional collar 14, FIG. 3, whose upper surface the shield 12 completely covers to protect the collar from being stained by hair gel or oil. The shield is essentially comprised of an outer or upper layer 16 of real or simulated leather and an inner layer or lining 18 that is preferably cloth. The two layers are connected together by stitching at their meeting edges. The upper and inner layers 16 and 18 are sewn together so as to follow the fold of the overcoat collar 14.

In accordance with the invention, the outer layer 16 has a smooth, non-absorbent surface so that any oil or grease it receives can be quickly and easily wiped off without staining. The cloth inner layer terminates at the outer longitudinal edge of the outer layer, and 18 extends inwardly beyond the inner longitudinal edge 20 of the outer layer to form an elongated flap 22 that extends downwardly inside the coat collar when the shield is in position as best shown in FIG. 3.

Figure 2:
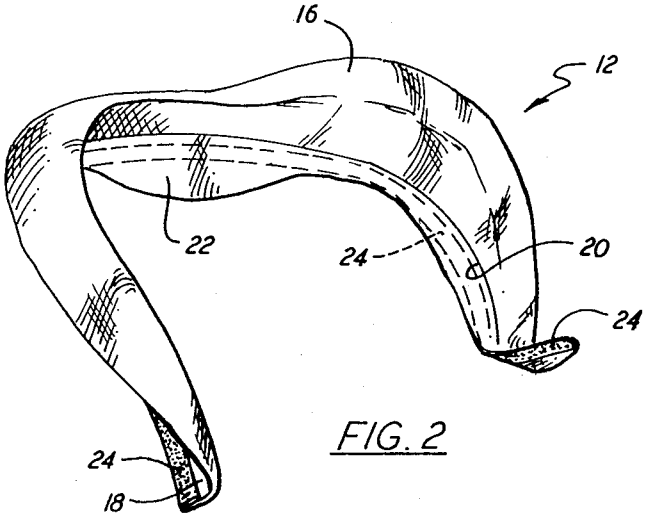
FIG. 2 is a front perspective view of the shield.
Figure 4:
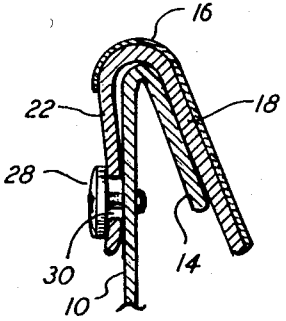
FIG. 4 is a view corresponding to FIG. 3 but showing an alternative fastening means.

The shield 12 is releasably held in position overlying the coat collar 14 by a "Velcro" strip 24, FIG. 3, on the lining flap 22 and a mating "Velcro" strip 26 inside the coat collar. These strips extend for the full length of the lining flap as indicated in FIG. 2. Alternatively, the shield can be releasably held in position by buttons inside the coat collar and corresponding button holes in the lining flap of the shield. Such a button 28 and button hole 30 are shown in FIG. 4.

The shield 12 is intended to be decorative as well as functional and can be made in any number of attractive configurations and colors depending on the style and color of the garment with which it is to be used.

From the foregoing description it will be apparent that the invention disclosed provides a novel and very advantageous protective shield. As will be understood by those familiar with the art, the invention may be embodied in other specific forms without departing from the spirit or essential characteristics thereof.

I claim:

1. A protective shield removably overfitting the external collar of an outer garment for preventing hair gel or oil from staining the external collar of the outer garment; the protective shield covering only an upper side of the collar, and comprising an outer layer of real or simulated leather having a smooth, non-absorbent surfaces; an inner layer of cloth at least coextensive with the outer layer, the inner layer being situated against the upper side of the collar and continuing to form an elongated flap that extends downwardly inside the collar of the garment; means connecting the inner and outer layers together to follow the fold of the collar of the outer garment; and means on the inner layer elongated flap cooperating with corresponding means inside the collar of the garment for permitting the protective shield to be releasably attached to the outer garment.

2. A protective shield as defined in claim 1 wherein the attachment means on the inner layer comprises button holes that coact with buttons on the outer garment.

3. A protective shield as defined in claim 1 wherein the attachment means on the inner layer comprises a "Velcro" strip that coacts with a "Velcro" strip on the outer garment.

4. In combination with an outer garment having a collar, a removable shield adapted to overlie an upper surface of the garment collar to protect it from being stained by hair gel or oil; the removable shield comprising an outer layer of real or simulated leather having a smooth, non-absorbent surface; a cloth lining for the outer layer that engages the garment collar when the shield is in position on the garment, said lining terminating at an outward edge of said outer layer, and extending beyond an inward edge thereof to form a flap that extends downwardly inside the neck of the garment; and coacting means on the garment and the flap of the cloth lining for releasably attaching the shield to the garment.

5. A shield as defined in claim 4 wherein the cloth lining projects beyond the outer layer at one edge thereof, the attachment means on the lining being on the projecting portion thereof 6. A shield as defined in claim 5 wherein the attachment means comprises buttons inside the garment collar and button holes in the cloth lining.

7. A shield as defined in claim 5 wherein the attachment means comprises mating "Velcro" strips inside the garment collar and on the cloth lining.

* * * * *